US007989762B2

(12) United States Patent
Holle et al.

(10) Patent No.: US 7,989,762 B2
(45) Date of Patent: Aug. 2, 2011

(54) AUTOMATIC CLEANING OF MALDI ION SOURCES

(75) Inventors: Armin Holle, Achim (DE); Jens Hörndorf, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 313 days.

(21) Appl. No.: 12/367,639

(22) Filed: Feb. 9, 2009

(65) Prior Publication Data

US 2009/0200457 A1 Aug. 13, 2009

(30) Foreign Application Priority Data

Feb. 12, 2008 (DE) ..... 10 2008 008 634

(51) Int. Cl.
*H01J 49/10* (2006.01)
*H01J 27/24* (2006.01)

(52) U.S. Cl. ..... 250/288; 250/424; 250/425

(58) Field of Classification Search ..... 250/282, 250/288

See application file for complete search history.

(56) References Cited

U.S. PATENT DOCUMENTS 6,504,150 B1 1/2003 Verentchikov et al.
6,953,928 B2 10/2005 Vestal et al.
6,992,311 B1 * 1/2006 Ring et al. ..... 250/492.21
7,109,480 B2 * 9/2006 Vestal et al. ..... 250/288
7,297,942 B2 * 11/2007 Holle et al. ..... 250/288
7,541,597 B2 * 6/2009 Holle et al. ..... 250/423 R
2005/0092916 A1 5/2005 Vestal et al.
2006/0192106 A1 * 8/2006 Hayden et al. ..... 250/288
2006/0255256 A1 * 11/2006 Hayden et al. ..... 250/282
2006/0255294 A1 * 11/2006 Martin, II ..... 250/492.3
2008/0010845 A1 * 1/2008 Bailey et al. ..... 33/520
2008/0272286 A1 11/2008 Vestal

FOREIGN PATENT DOCUMENTS

DE 103 16 655 A1 8/2004
DE 103 16 655 B4 11/2007

* cited by examiner

*Primary Examiner* — Jack I Berman
*Assistant Examiner* — David Smith
(74) *Attorney, Agent, or Firm* — Law Offices of Paul E. Kudirka

(57) ABSTRACT

In an ion source that generates ions by matrix-assisted laser desorption (MALDI), ion acceleration diaphragms having apertures though which ions are accelerated and which have become contaminated by matrix material, are cleaned by temporarily heating the diaphragms. During the cleaning process, the sample support plate is moved aside but remains in the ion source housing, and the heating is preferably limited to regions surrounding the apertures in the diaphragms. In one embodiment, the diaphragms are heated by irradiation generated by infrared laser diodes.

20 Claims, 2 Drawing Sheets

AUTOMATIC CLEANING OF MALDI ION SOURCES

BACKGROUND

The invention relates to the cleaning of ion sources for the generation of ions by matrix-assisted laser desorption (MALDI). Ion sources for the ionization of samples by matrix-assisted laser desorption (MALDI) are increasingly being used for the ionization of large molecules such as large biomolecules or synthetic polymers. In at least some fields of application in molecular biology and medical diagnostic research, higher and higher scanning rates are being demanded. Sample support plates nowadays usually hold 384, sometimes even 1536 sample spots for the analysis of individual samples. This analytical method involves exposing every sample with several hundred laser shots, so that between several hundred thousand and one million vaporization processes are necessary to analyze the samples from one sample support plate. In imaging mass spectrometry of histologic thin sections with high spatial resolution, many millions of such vaporization processes are carried out on one such histologic thin section on the sample support plate.

In MALDI ion sources, each bombardment of the samples, which contain large amounts of matrix substances in addition to the analyte substances, with the pulses of laser light generates a plasma cloud, from which the ions formed are then extracted by switching on an accelerating field. In some cases, the plasma cloud also contains solid or liquid spray particles from the quasi-explosion of the matrix material. The plasma cloud expands further, and some of the vaporized or sprayed material (mainly matrix substance with traces of analyte substance) is deposited on the acceleration diaphragms. After several hundred thousand shots, i.e. after the throughput of about ten sample support plates each containing 384 samples, or after the high spatial resolution analysis of about one square centimeter of a histologic thin section, visible coatings develop on these acceleration diaphragms around the apertures through which the ion beam passes. These coatings are electrical insulators; they can become electrically charged and interfere with the acceleration and focusing process for the ions. The coatings therefore have to be removed.

The matrix substances which are used for the matrix-assisted laser desorption (MALDI) sublime in the vacuum in noticeable quantities even at room temperatures. While the pre-prepared sample support plates can be kept under airtight conditions for more than a year without any detrimental effects, they cannot be left in a vacuum for several days without undergoing changes in the sample preparations. Under no circumstances must the sample support plates be subject to appreciable warming in the vacuum. Therefore, it is not possible to simply heat up the MALDI ion sources, as is usually done with electron impact ion sources.

Modern mass spectrometers are equipped with automatic feeding systems for sample support plates. They can thus also work through the night or even over the weekend with thousands of samples. However, the contamination problem prevents these automatic feeding systems from being operated at full capacity.

The method used almost exclusively until a few years ago for removing this coating has been to clean the electrodes manually after venting and opening the ion source. The cleaning is usually carried out with solvents such as ethanol or acetone. After opening the ion source housing, it is generally possible to clean the first acceleration diaphragm without removing the ion source; but even then, cleaning and restoring a good vacuum takes several hours, and after the mass spectrometer has been put into operation again it often has to be readjusted, and generally a complete recalibration of the calibration function for calculating the masses from the flight times must be carried out. If the ion source has to be removed for cleaning, the method takes even longer and requires an even more extensive adjustment.

A recent proposal (A. Holle and J. Franzen, DE 103 16 655 A1) involves using a specially designed cleaning plate, having precisely the same shape as the sample support plate, to clean the first acceleration diaphragm by spray-washing with solvent or by brushing. However, not only the first acceleration diaphragm but also more distant acceleration diaphragms are contaminated. The more distant acceleration diaphragms stay uncontaminated for much longer, but when the instrument is in operation for a long time with high throughput, they too have to be cleaned.

The patent application DE 10 2005 054 605 A1 (A. Holle and G. Przybyla) suggests cleaning with a reactive gas discharge, which can be automatically carried out by moving out the sample support plate, moving in a specially shaped electrode plate and admitting a reactant gas.

The two above-mentioned methods require that the sample support plate be removed from its mounting device in the ion source, however. This is particularly disadvantageous if the mass spectrometric imaging analysis of histologic thin sections is interrupted, because the sample support plate in the mounting device cannot be precisely repositioned in its earlier position with the necessary micrometer accuracy. This results in a displacement of unknown magnitude between the images before and after cleaning.

A simple cleaning method is therefore still being sought which allows the sample support plate to remain in its mounting device in the ion source. Automatic cleaning is sought for because increasing use of mass spectrometers by molecular biologists and medical professionals means that complications in the operation of the mass spectrometer must be avoided.

SUMMARY

The method according to the invention comprises moving aside the sample support plate with its mounting device from at least the center of the first acceleration diaphragm, and temporarily heating up specifically the area around the ion beam apertures in the acceleration diaphragms in the ion source to a sufficient degree that the matrix material deposited or splashed on the diaphragms vaporizes by sublimation in the vacuum. Temperatures between 80 and 250 degrees Celsius are required depending upon the type of matrix material, but they must only be maintained for a short time, between one and ten minutes. The heating can be achieved by direct or indirect electric heating, by induction heating, or, particularly favorably, by the energy of electromagnetic radiation, for example by irradiation with the infrared light of suitable laser diodes.

In order that the heating does not damage the matrix substance of the sample preparations on the sample support plate, it is expedient to minimize the total heat applied, to concentrate it on the contaminated areas of the acceleration diaphragms around the ion beam apertures, and to keep the total heating-up time as short as possible. To this end, the material of the acceleration diaphragms in the region around the ion beam apertures can be thermally insulated with respect to the more outlying parts of the acceleration diaphragms, for example by an enclosing ring of holes with relatively thin strips between the holes. Applying infrared radiation from laser diodes with a few watts of light output allows the aperture areas to be heated up sufficiently in less than one minute. The cooling-down time is usually a little longer, but the analytical process is interrupted for less than ten minutes. The sample support plate can then be brought into the position required for the analysis with micrometer accuracy because the movement mechanism for the sample support plate usually has a positional accuracy of a few micrometers. However, the prerequisite for this positioning accuracy is that the sample support plate is not shifted in its mounting device.

The mass spectrometer according to the invention contains a device for heating up the areas of the acceleration diaphragms around the ion beam apertures. A particularly favorable heating device consists of laser diodes for light of suitable wavelengths, which irradiate the region to be heated up either directly or guided by fiber-optic cable. Acceleration diaphragms with thermal isolation of the region of the diaphragm material around the ion beam apertures from the outer diaphragm material are favorable.

DETAILED DESCRIPTION

Figure 1:
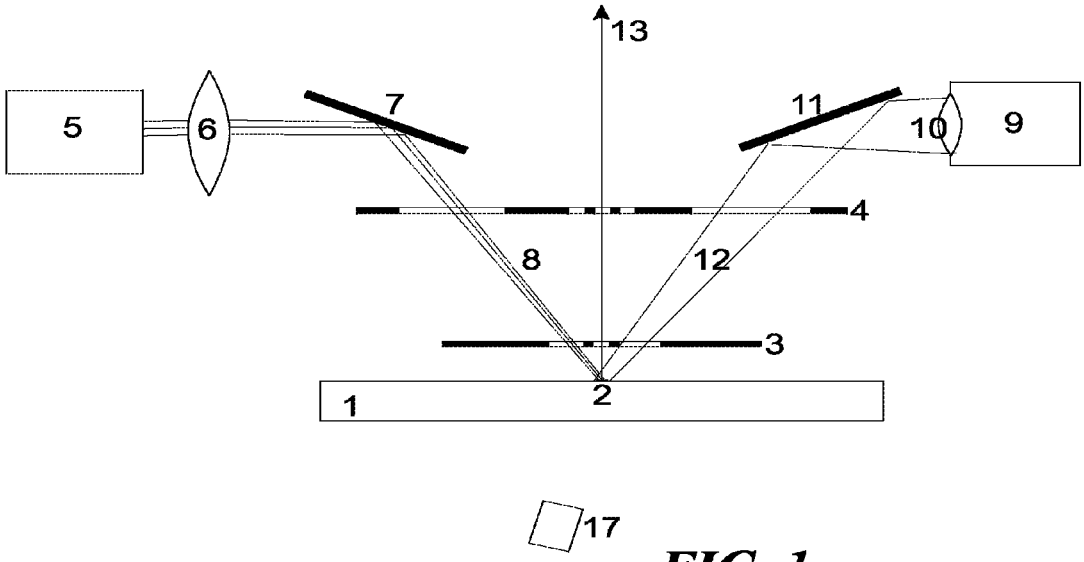
FIG. 1 shows an embodiment of an ion source for matrix-assisted laser desorption with a laser diode (17). The ion source is in analysis mode and the laser diode (17) is switched off. The desorption laser (5) irradiates the sample (2) on the sample support plate (1) with a light pulse that generates analyte ions, which are accelerated by the acceleration diaphragms (3) and (4) to form an ion beam (13). The light source (9) is used to illuminate the sample.

While the invention has been shown and described with reference to a number of embodiments thereof, it will be recognized by those skilled in the art that various changes in form and detail may be made herein without departing from the spirit and scope of the invention as defined by the appended claims.

The invention relates to both methods and devices to clean ion source electrodes in ion sources inside a mass spectrometer, especially ion source electrodes in ion sources for ionization by matrix-assisted laser desorption.

The method according to the invention consists in first moving aside the sample support plate temporarily to protect it from heat radiation, and then heating up the acceleration diaphragms for a period of a few minutes, whereby the deposits, consisting predominantly of matrix substance, sublime into the surrounding vacuum. The various matrix substances require temperatures of between 80 and 250 degrees Celsius for this, mostly between 120 and 220 degrees Celsius. In order to minimize the total heat input, the heating is preferably restricted to the small regions of the acceleration diaphragms around the ion beam apertures.

The heating is restricted to this area around the ion beam apertures by targeting the heat supply only to this region and by using a heat flow barrier to inhibit heat conduction into the outer area of the diaphragm. In the simplest case, this barrier can consist of one or more rings of holes arranged around the ion beam aperture and leaving only narrow strips between the holes for conducting the heat. The holes should be as small as possible in order not to distort the electric accelerating field. It is also advantageous if the acceleration diaphragms are formed in such a way that, at least for the second acceleration diaphragm, only the region around the aperture for the passage of the ion beam can be coated or splashed from the sample.

The heating can be achieved by attaching heating elements or also by inductive heating, for example. It is not easy to attach heating elements, at least to the first acceleration diaphragm, because the diaphragm must be subjected to potentials of about 30 kilovolts and, therefore, the heating element, its supply leads or its switching elements need to be extremely well insulated. Inductive heating has the slight disadvantage that the heating is not easily restricted to a small area.

It is therefore preferable to irradiate with light of a suitable wavelength, at least for the first acceleration diaphragm. Pumping diodes for solid-state lasers supply light outputs of about 30 watts. Only around one to five watts, at most, are required to heat up a small part of an acceleration diaphragm. The light output can be kept particularly small if the irradiated area has a high absorptivity, which can be achieved by oxidative etching or by graphitization, for example. The light output of a laser diode can be steered directly onto the area to be heated up or conducted by a fiber-optic light guide. It is usually possible to avoid optical elements such as lenses. With a good design, the temperatures required for cleaning can be reached in less than a minute.

When the required temperature is exceeded, the coatings disappear within a short time; after a few seconds, or a minute at most, the coatings have disappeared. Some of the vaporized matrix material is pumped off by the vacuum pumps of the mass spectrometer, and some is deposited on other regions of the ion source, for example on the walls of the housing. These coatings usually do not cause any interference. They can be removed by cleaning the ion source housing during occasional visits of the service technicians.

The condensation of sublimed matrix material can, however, be directed onto specific areas. The mounting device for the sample support plate (the mounting device and sample support plate together have a considerable mass), can, for example, have a condensation surface at the side, which is positioned in front of the central region of the first acceleration diaphragm when the sample support plate is moved and takes up a large proportion of the sublimed material. The light beam for the heating can pass through an aperture in this plate. Or a surface especially cooled by Peltier elements can be permanently installed in the region behind the sample support plate. Part of the ion source housing can also be specifically cooled from the outside, by simple water cooling, for example. Or a cold finger can extend into the ion source and be supplied with a refrigerant. The cooling of the ion source housing, or only part thereof, is not only favorable for a targeted condensation of the vaporized contaminants, but also for keeping the sample in a good condition.

Figure 2:
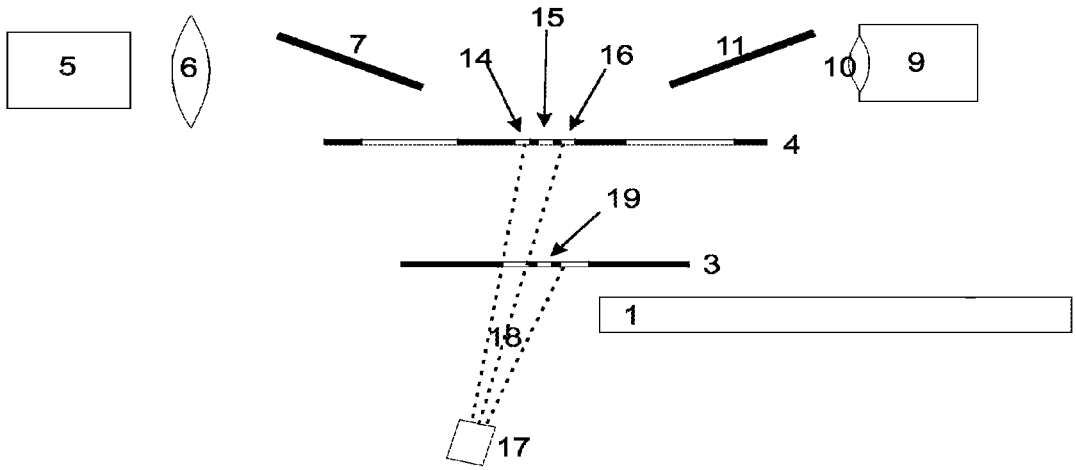
FIG. 2 shows the cleaning mode. The sample support plate (1) is moved to one side; the light beam (18) from the laser diode (17) irradiates both the acceleration diaphragm (3) in the area around the aperture (19) for the passage of the ion beam, as well as the acceleration diaphragm (4) in the area around the aperture (15) for the passage of the ion beam. The aperture (15) of the acceleration diaphragm (4) is surrounded by a ring of holes (14, 16) which forms a thermal barrier and inhibits rapid heat loss.
Figure 3:
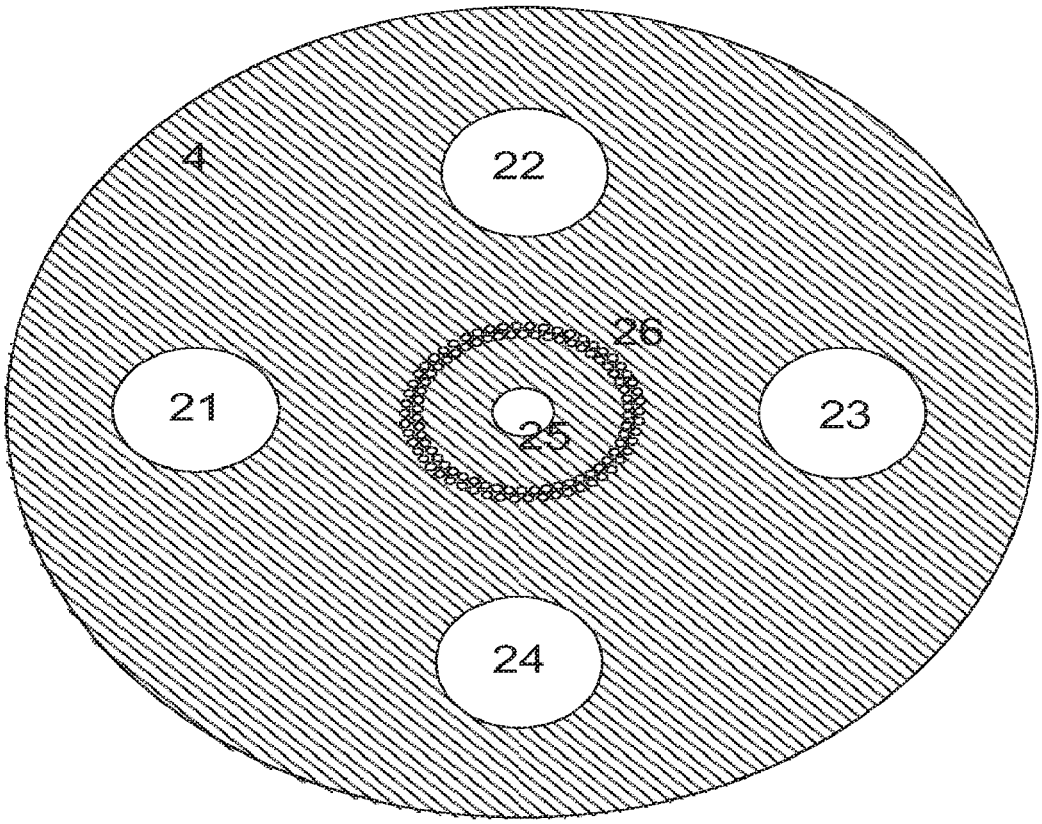
FIG. 3 shows the acceleration diaphragm (4) of FIGS. 1 and 2, with an aperture (25) for the passage of the ion beam and a double ring of holes (26) to inhibit heat loss. The apertures (21) to (24) serve for the passage of the laser beam, the illumination of the sample and the video observation.

The light for heating can be irradiated onto the acceleration diaphragms either in the direction of the ion flight, past the sample support plate which has been moved aside, as shown in FIGS. 1 and 2, or backward from the direction of the flight path of the ions. Irradiation from the rear can also be accompanied by a reverse roughening or profiling of the acceleration diaphragms to increase the absorptivity of the diaphragm surface.

FIG. 1 shows an ion source in the state for the ionization of solid samples (2) on a sample support plate (1) by pulsed laser light from a laser (5). As is frequently the case, the ion source essentially consists simply of the sample support plate (1), which is at a high voltage, and two electrodes, namely the first acceleration diaphragm (3) and the second acceleration diaphragm (4), which is usually grounded. The first acceleration diaphragm (3) is often only a few millimeters (for example three millimeters) away from the sample support plate (1). The second acceleration diaphragm (4) is usually further away from the first acceleration diaphragm (3), for example ten millimeters. If the electrodes (3) and (4) do not take the form of metal grids, they have several apertures for the passage of the ion beam (13), the laser beam (8), and the light (12) from a spot light device (9), and for observing the samples on the sample support plate with a video camera (not shown in FIG. 1, since this device is outside the image plane).

In analytical mode, the sample (2) on the sample support plate (1) is bombarded by a pulsed beam of laser light (8) from the laser (5), which is focused by a lens (6) and deflected by a mirror (7) onto the sample (2). The light beam (12) from the spot light device (9) is focused via lens (10) and deflected via mirror (11) onto the sample (2). The illuminated sample (2) can be observed with a video camera located outside the image plane. The laser light bombardment causes a vaporization plasma to form in the sample (2); after a brief expansion period, the ions of the vaporization plasma are extracted by means of a switched voltage difference relative to the first acceleration diaphragm (3) and can be formed into an ion beam (13). The laser diode (17) is positioned behind the sample support plate (1) and is not switched on.

After several thousand samples have been analyzed, which requires several hundred thousand laser shots, impurities in the form of vaporized or splashed matrix material from the samples appear in the center of the first accelerating electrode (3), and to a lesser extent on the second accelerating electrode (4) as well. These impurities are not conducting electrically; they therefore become electrically charged and the electric fields of their charges interfere with the electric accelerating fields, deflecting and defocusing the ion beam. They therefore have to be removed.

FIG. 2 shows the configuration of the ion source for the cleaning process. The sample support plate (1) has been moved aside. The laser diode (17) now irradiates the central region of the acceleration diaphragm (3) around the ion beam aperture (19), and also the central region of the acceleration diaphragm (4) around the ion beam aperture (15), with a slightly divergent light beam (18). This latter region around the aperture (15) is thermally insulated from the more outlying region of this acceleration diaphragm (4) by a ring of holes, of which the holes (14, 16) are visible here. For the first acceleration diaphragm this thermal insulation is already achieved by means of the holes for the laser irradiation, video observation and sample lighting. The light beam from the laser diode (17) must have sufficient power to achieve the heating up in a matter of minutes. Rapid heating is required to minimize the total amount of heat applied.

It is, however, not necessary to heat both acceleration diaphragms (3) and (4) with the same heating device. For example, the first acceleration diaphragm (3) can be heated by a laser diode, and the second acceleration diaphragm (4), which is always at ground potential, can be heated by attaching a heating element.

The acceleration diaphragms do not have to be apertured diaphragms; they can also take the form of fine wire grids. These grids can also be heated with a light beam, and there is an automatic thermal insulation between the irradiated grid surface and the more outlying regions. When the general term "acceleration diaphragms" is used here, it includes grid diaphragms.

The cleaning process is controlled by a cleaning control program which considers the type of matrix material and adjusts the heating power and the heating period accordingly. This program can be started manually by the operator of the mass spectrometer. It can also be started automatically using the information on the number of laser shots since its last cleaning, for example. It is therefore possible, for example in high-throughput analyses which run over a weekend, to automatically carry out the cleaning of the ion source electrodes each time a predetermined number of sample support plates (each containing 384 or 1536 samples, for example) have been analyzed. It particularly makes it possible to start cleaning processes in the middle of scanning with high spatial resolution for imaging mass spectrometry on samples with histologic thin sections.

A slightly convex mirror can be located at the edge of the sample support plate (1) and can be moved to the position that is occupied by the sample during the analysis. With the aid of this mirror it is possible to check the cleaning of the central region of the acceleration diaphragm (3) via the video camera. If the cleaning process is started manually, it can be checked visually by the operator by examining the image on the screen. The check can also be done automatically using an image evaluation program. In this case it is particularly possible to document the cleaning in images, or even to regulate it.

What is claimed is:

1. A method for cleaning an ion source of a mass spectrometer in which samples on a mobile sample support plate, situated in a mounting device located in the ion source, are ionized by matrix-assisted laser desorption and resulting ions are accelerated by a plurality of acceleration diaphragms to form an ion beam, the method comprising the steps of:

(a) moving the sample support plate in the mounting device to a position in the ion source and away from the acceleration diaphragms; and (b) heating a portion of a first acceleration diaphragm for a time duration between one and ten minutes to a temperature between 80 and 250 degrees Celsius, wherein heat input is restricted to an area that is less than the area of the first acceleration diaphragm and located around an ion beam aperture.

2. The method of claim 1, wherein step (b) comprises heating portions of all acceleration diaphragms.

3. The method according to claim 1 or 2, wherein each acceleration diaphragm has an aperture that allows passage of the ion beam and wherein step (b) comprises heating a portion of an acceleration diaphragm only in the vicinity of the aperture of that acceleration diaphragm and restricting conduction of heat to other portions of that acceleration diaphragm.

4. The method of claim 3, wherein conduction of heat is restricted on each acceleration diaphragm by forming a ring of holes around the aperture of that diaphragm.

5. The method of claim 1, wherein step (b) comprises using a heating element that is separate from, and attached to, the first acceleration diaphragm to heat the portion of the first acceleration diaphragm.

6. The method of claim 1, wherein step (b) comprises using a heating element that is part of the first acceleration diaphragm to heat the portion of the first acceleration diaphragm.

7. The method of claim 1, wherein step (b) comprises using an inductive heating element to heat the portion of the first acceleration diaphragm.

8. The method of claim 1, wherein step (b) comprises using one of heat and light radiation to heat the portion of the first acceleration diaphragm.

9. The method of claim 8, wherein step (b) comprises irradiating the portion of the first acceleration diaphragm with light radiation from laser diodes.

10. The method of claim 9, wherein step (b) comprises using fiber-optic light guides to conduct the light radiation from the laser diodes to the portion of the first acceleration diaphragm.

11. The method of claim 8, wherein each acceleration diaphragm has an aperture that allows passage of the ion beam and wherein the one radiation is applied to the first acceleration diaphragm in such a manner that some of the one radiation passes through a hole in the first acceleration diaphragm and heats a portion surrounding an aperture of a second acceleration diaphragm.

12. The method of claim 11, wherein the heated portion of at least one of the first and second acceleration diaphragms is insulated from the rest of the one acceleration diaphragm so that that the heated portions of the first and second acceleration diaphragms are heated substantially equally.

13. The method of claim 1, further comprising:

(c) using a video system to carry out a visual check of the cleaning process.

14. The method of claim 8, further comprising:

(c) heating one of the plurality of acceleration diaphragms that is maintained at ground potential with attached heating elements.

15. A mass spectrometer comprising:

an ion source for producing ions by matrix-assisted laser desorption of a sample, the ion source having a plurality of acceleration diaphragms, each diaphragm having an aperture through which the ions are accelerated to form an ion beam; and a heating device that heats a region of at least one of the acceleration diaphragms, which region surrounds the aperture of that diaphragm and has an area less than the total area of that diaphragm to a predetermined temperature within a predetermined time period, wherein heat input from the heating device to that diaphragm is restricted to the region.

16. The mass spectrometer of claim 15, wherein the heating device comprises a laser diode that generates a light beam.

17. The mass spectrometer of claim 16, wherein the heating device further comprises a fiber-optic light guide to guide the light beam from the laser diode to the acceleration diaphragms.

18. The mass spectrometer of claim 15, wherein at least one of the plurality of acceleration diaphragms has a ring of holes around the aperture of that acceleration diaphragm to thermally insulate the heated region of that acceleration diaphragm from the remainder of that acceleration diaphragm.

19. The mass spectrometer of claim 16, wherein the heated region of each acceleration diaphragm comprises a surface which absorbs the light beam.

20. The mass spectrometer of claim 15, wherein the ion source comprises a cooled surface area for the condensation of material that evaporates when the portions of the acceleration diaphragms are heated.

* * * * *